US006035682A

United States Patent [19]

Dorigo

[11] Patent Number: 6,035,682

[45] Date of Patent: Mar. 14, 2000

[54] METHOD AND RESPECTIVE HOT ROLLING-MILL PLANT FOR THE CONTINUOUS PRODUCTION OF BARS, RODS OR WIRE

[75] Inventor: Alessandro Dorigo, Tarcento, Italy

[73] Assignee: S.I.M.A.C. SpA, Tarcento, Italy

[21] Appl. No.: 09/101,678

[22] PCT Filed: Jan. 21, 1997

[86] PCT No.: PCT/IT97/00013

§ 371 Date: Jul. 15, 1998

§ 102(e) Date: Jul. 15, 1998

[87] PCT Pub. No.: WO97/27010

PCT Pub. Date: Jul. 31, 1997

[30] Foreign Application Priority Data

Jan. 26, 1996 [IT] Italy ..... UD96A0006

[51] Int. Cl.[7] ..... B21B 1/00; B21B 27/06

[52] U.S. Cl. ..... 72/204; 72/200

[58] Field of Search ..... 72/203, 204, 200, 72/201, 202, 365.2, 366.2; 29/527.5

[56] References Cited

U.S. PATENT DOCUMENTS 3,756,055 9/1973 Marcovitch ..... 72/204
5,303,766 4/1994 Kreijger et al. ..... 29/527.7
5,634,510 6/1997 Hirano et al. ..... 29/527.7

FOREIGN PATENT DOCUMENTS 61 67502 4/1986 Japan ..... 72/204

*Primary Examiner*—Rodney C. Butler
*Attorney, Agent, or Firm*—Wenderoth, Lind & Ponack, L.L.P.

[57] ABSTRACT

Method and respective hot rolling plant for the continuous production of bars, iron rods or wire, of the type in which the rolled section is cut longitudinally in which: the result is a thin flat bloom (A) with large flat (B) with a thickness close to that of the maximum section of the bar, iron rod or wire to be obtained and with a width equal to at least one multiple of said maximum section; said large flat (B) is further rolled by opposite annularly grooved rolls (23), to shape in contra-opposition the opposite buckled surfaces and recesses in order to bring the section of large flat to the shape of ovals or lozenges one connected to the other for a very thin rolling thickness between the section of one and the section of the other in correspondence of the minimum of said opposite recesses (C); said sections are longitudinally separated in correspondence of the respective thickness minimum, creating a bed of rod sections (D) in continuous advancement, in which each rod section makes up the bar or iron rod to be obtained (E); the rolling of the single rod sections (D) continues up to the obtainment of the shape of the finished products (E).

6 Claims, 5 Drawing Sheets

METHOD AND RESPECTIVE HOT ROLLING-MILL PLANT FOR THE CONTINUOUS PRODUCTION OF BARS, RODS OR WIRE

TECHNICAL FIELD

This invention has for its object a method and hot rolling plant for the continuous production of bars, iron rod or wire. The invention finds particular even if not exclusive application in the field of the production of bars, iron rods or wire by the hot-rolling of metals, particularly steel.

BACKGROUND ART

In the prior art, different production methods are known. Among these the one which is most used relates to the rolling of billets from a continuous casting plant. The method progressively thins them in section, until reaching the diameter of the bar, iron rod or wire that must be obtained.

In the case of small rolled sections, it is clear that the work is remarkably expensive, both in terms of time, complexity and cost. In order to be productive, the rolling speed was constantly and continuously increased, greatly exceeding 30 m/sec. for straight bars and 100 m/sec. for bars (wire) to be wound on a bobbin. The speed increase involves limits not easily surmountable, and therefore when the maximum limit is almost reached, it is no longer possible to obtain an appreciable increase if not at prohibitive costs of the plant, production and maintenance.

Attempts have been proposed for parallel rolling, starting from continuous casting in a billet. Parallel rolling has never been successful, and notwithstanding the numerous projects and patents in the prior art, it has never found a large application due to its complexity. The need for intervention on a single line, for example due to jamming, makes rolling on the other line practically impossible.

At present "split" rolling is greatly used, which consists of producing two iron rods from a previous shaping by splitting a stock into two rods, rotating them 90°, and further rolling them in a final section (JP-A-60-130401). It is also possible to make four iron rods with two successive splits simultaneously on the same rolling stand, starting from the same billet.

This rolling always starts from a billet coming from a heating furnace, not directly connected to the continuous casting, because the casting speed for billets of sizes conveniently productive (ex. 160×160 mm) is very slow, about 3 m/sec. max., equal to an hourly production of 37 Ton/h (theoretically), i.e., low. Such rolling speed (3 m/min–0.05 m/sec.) is not supported by the rolling stands and would cause cracks and failures to the rolls because of excessive heating of the latter. Additionally, starting from a 160×160 mm billet to obtain an iron rod of 8.5 mm of diameter, approximately 18 stands are necessary.

To be productive, these plants must have an entrance speed of the billet in the first rolling stand higher than the casting speed (about three times). Consequently, the rolling stands must be fed by more than one continuous casting line (at least 2 or 3 lines).

Another disadvantage is the increase in waste as a result of head and tail discard necessary for each wire produced.

DE-4009861A (SMS) discloses a steel rolling plant for producing "long bars" starting directly from a continuous casting plant (1) with multi-exit casting lines (six lines, ref. 3). The six exit casting lines 3 that are conveyed in a heating furnace and then are orthogonally rolled:

in one solution with a single line of a rolling mill, in an alternative solution with a plurality of rolling mill lines.

This solution has the same inconveniences as the above described solutions.

Patent Abstract of Japan, vol. 7, n.44 (M-195), Feb. 22, 1993 & JP 57193205 disclose a rolling mill plant for rolling a large slab, shaping it in a continuous form to realize a plurality of square sections diagonally disposed and connected in a thin line by their opposite corners. This is obtained along its longitudinal direction by caliber rolling and forming these to steel bars by rolling in succession. The abstract clarifies that the prescribed slab is obtained from steel making, then through ingot making, blooming and continuous casting. This slab is subjected to primary rolling down to a prescribed intermediate thickness, whereby an intermediate blank material is obtained.

This intermediate blank material is heated and is formed with grooves in its longitudinal direction with caliber roughing rolls, after which it is split and cut to plural pieces of square materials with final rolls. These square materials are subjected to secondary rolling and finish rolling in succession, whereby products such as steel bars and steel rolls of the required size are obtained. This solution is a normal solution of transforming a material by a plurality of stages. In this way one is not able to solve the above problems.

Nevertheless, combining the teaching of the last two solutions, we are able to realize a new process or plant able to solve the above problems.

SUMMARY OF THE INVENTION

The aim of this invention is to avoid the above-mentioned drawbacks with not too high a rolling speed, and to allow production of considerably greater quantities of rolled sections.

This and other objects are attained by a method and hot rolling plant for the continuous production of bars, iron rods or wire of the type in which the rolled section, coming from a continuous casting, is rolled and cut longitudinally to form bars. According to the invention, a continuous line, without interruption, starts from a continuous casting for the production of thin slabs.

The thin slabs are rolled by crushing flat rolls until they are a large flat with a thickness close to that of the maximum section of the final bar section to be obtained. The width of the large flat is equal to at least one multiple of the maximum section of the bar section to be obtained, more than two in number.

The large flat is further rolled by opposite annularly grooved cylinders to shape in contra-position opposite buckled surfaces and recesses in order to bring the section of the large flat to the shape of ovals or lozenges, one connected to the other for its entire width. The ovals or lozenges are longitudinally separated in correspondence to the respective minimum thicknesses, creating a bed of bar sections in continuous advancement, each one making up the next bar or iron rod to be obtained. Thereafter, the rolling of the single rod sections continues until obtaining the shape of the finished product.

Advantageously, even after the longitudinal separation of the large flat, the whole group of rod sections will continue to be rolled by rolling stands with multiple rolling channels, in quantity as many as the rod sections in the rolling, until the definitive section is reached.

In the case that round sections are to be obtained, it will be possible to obtain at first an oval squashed section with longitudinal opposite cut burrs, then their 90° rotation and subsequent opposite rotation will be provided for, bringing them to a definitive round section. In this way there is the advantage of also removing the burrs. At the end the rod sections so obtained may be cut into bars, normalized, cooled, packed and tied as in common practice, or previous discarding, directly sent to respective winding machines (production of wire rod or wire).

The longitudinal separation cutting of the shaped large flat will be carried out by any means of the known techniques. Advantageously the longitudinal cutting will be carried out by means of opposite rolls with staggered grooves, or by fixed separating cutters (also opposite) not excluding disk rotating cutters.

The support of shares, also rotating (disk) or separating blades, in the separation could be useful. As an alternative to the continuity of the line connected to the casting, or for the shortening of the same line, some winders/unwinders of the large flat can be provided.

In this way there are the immediate advantages of:

- a direct and advantageous productive connection of the rolling mill to the continuous casting, because the casting speed of the thin flat bloom is compatible with the speed of the first rolling stand;
- an increase in the production with an advancement speed that is not necessarily high;
- a simplification of the plant and a reduction of the space occupied, with obvious reductions also in the infrastructure costs and invested capital;
- a reduction of the energy utilized and of energy waste;
- a reduction of the maintenance costs due to the simplification of the plant;
- a reduction of the use of cooling;
- a reduction in personnel also equal production; and
- higher control assurance.

BRIEF DESCRIPTION OF THE DRAWING

The above and other advantages will become apparent from the following description of preferred solutions with the aid of the enclosed drawings, whose details are not to be considered as limitative, but only give as an example.

DETAILED DESCRIPTION OF THE PREFERRED EMBODIMENT

Figure 1:
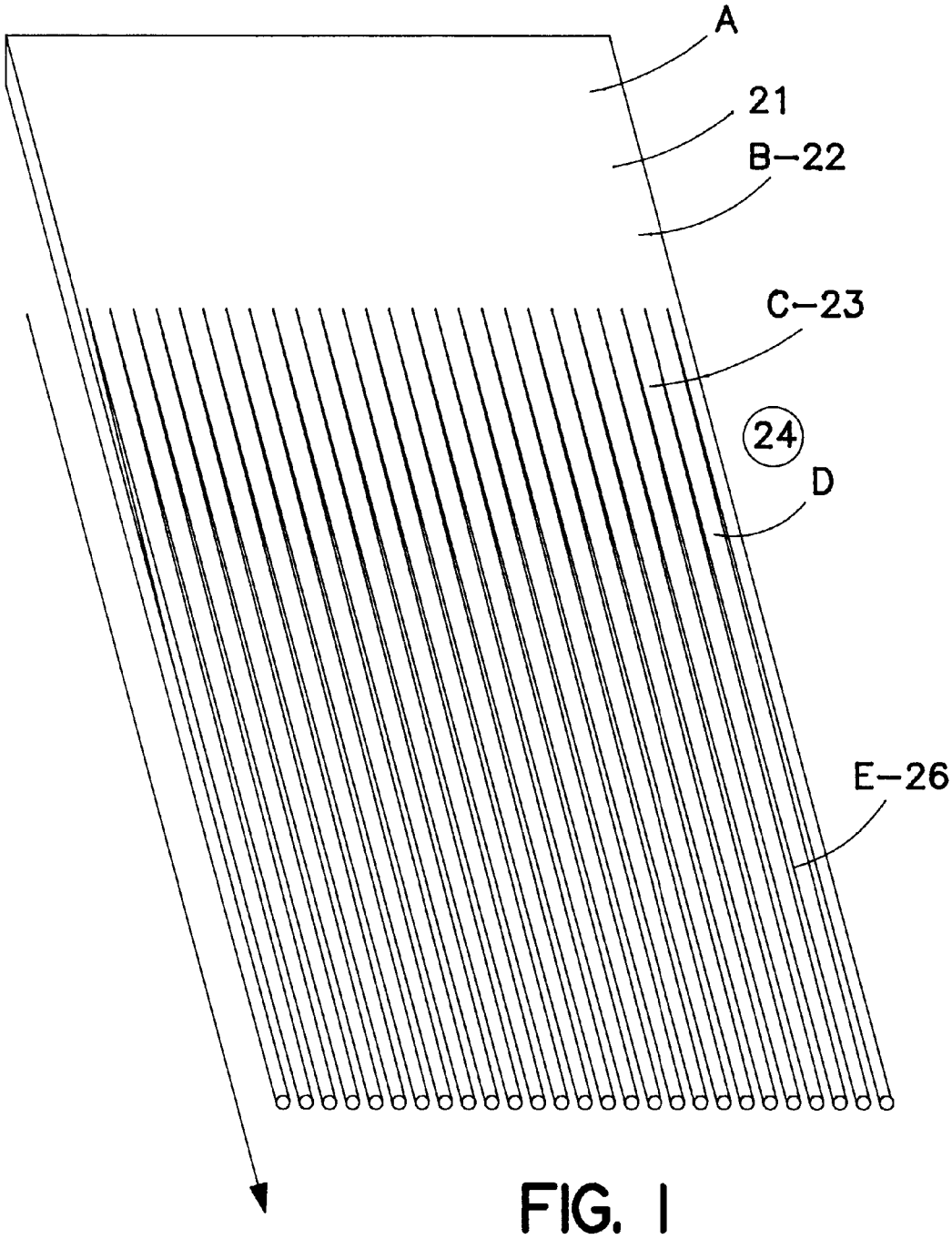
FIG. 1 shows a schematic view of a transformation process of a rolled section during rolling, where a final indicated section is shown as round, but which could obviously be square, rectangular, or of any other desired shape.
Figure 2:
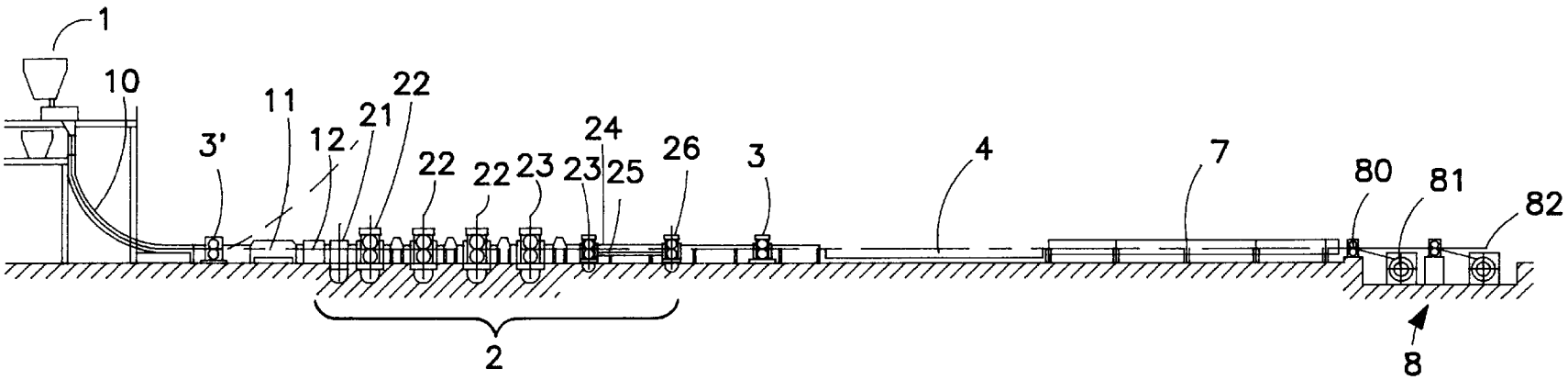
FIG. 2 is a schematic side view of an example of a continuous cycle rolling plant, starting from continuous casting, to obtain a bar packed and tied in bundles or optionally on a bobbin.

Referring to the figures, it can be seen that reference 1 indicates a continuous casting plant, and 10 indicates a continuous casting line to obtain a continuous thin flat bloom (approximately 50×800 mm.) Ref. A. 11 indicates an induction furnace to again bring the continuous flat bloom to a suitable rolling or equalizing temperature; 12 indicates a descaling machine to eliminate the scales from the flat bloom in continuous advancement (speed of about 0.1 meters/sec.); and 2 indicates a series of rolling stands with opposite rolls in a suitable and proper number, which progressively include:

- a first rolling stand (21) with vertical rolls, having the function of facing rolling the flat bloom to ensure a constant width;
- stands (22) having squashing flat rolls, having the function of pressing down the flat bloom from the casting thickness to a thickness close to the final product; and
- stands (23) for rolling with opposite annularly recessed rolls, providing for the shaping of the large flat in preparatory ovals or adjacent longitudinal lozenges, one attached to the other (C).

24 indicates a means for separating the ovals to form rough rod sections (D), in this particular case with co-penetrating opposite cutting disks (24 FIG. 5). 25 indicates possible means for the rotation of rough sections (D) 90°. 26 indicates a finishing rolling stand for giving the definitive shape to the ovals or lozenges to obtain the rod sections (bars, iron rods etc.) as desired (E).

Figure 3:
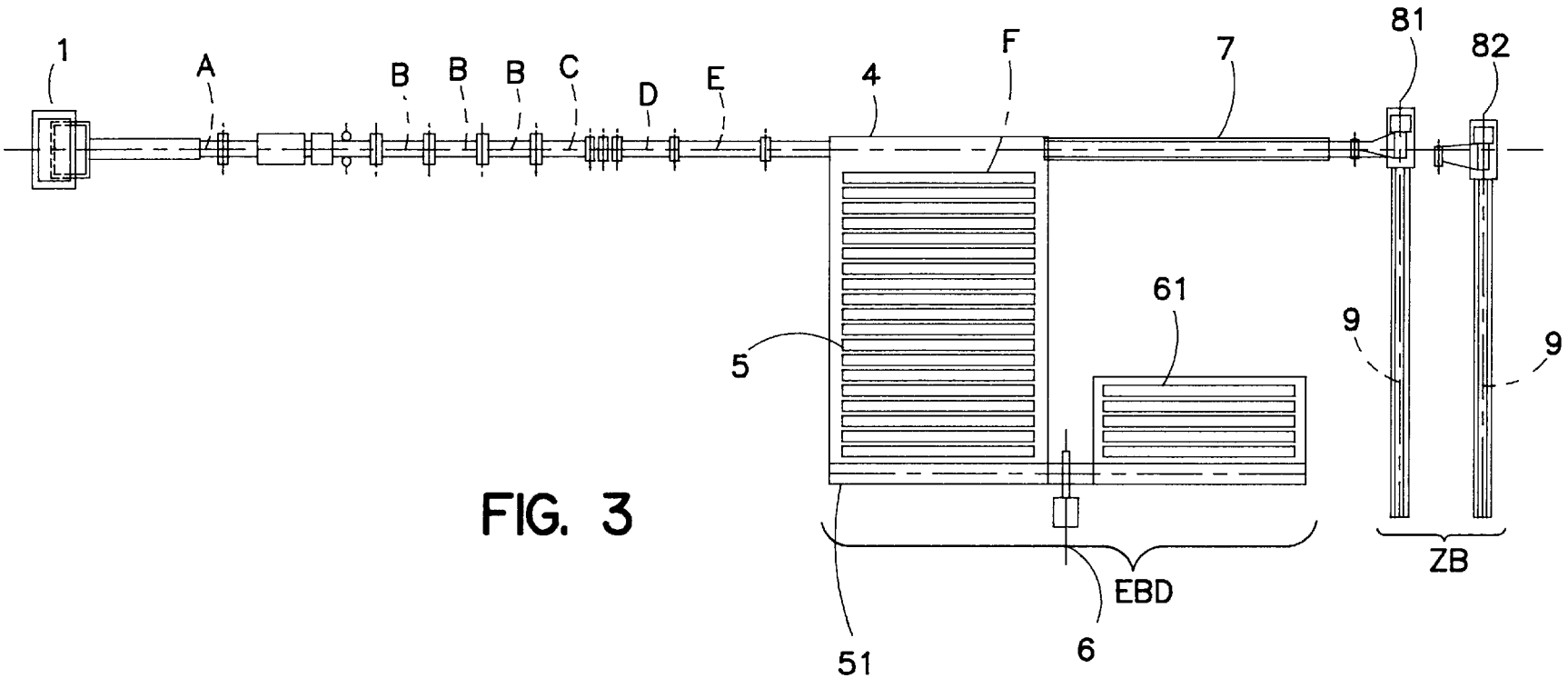
FIG. 3 shows a schematic plan view of the plant shown in FIG. 2.

These transformation phases are indicated as examples in FIG. 1 in relation to FIG. 3 with references to A,B,C,D,E. (A) indicates the thin flat bloom; (B) indicates the large flat; (C) indicates the shaped flat; (D) indicates the separated ovals or lozenges; and (E) indicates the finished rod sections (bars or iron rods, etc.).

At the end of the rolling, as explained above, there may be a continuous winding line with a corresponding plurality of bobbins, one for each wire, as a multi-wire winding machine (8, 81–82).

Discarding will be ensured by a flying shear (3) with a couple of rotating cutters for the opposite cutting of the wire groups. Equally advantageously, there may be installed at the end, in an alternative, a bars forming line by using a flying shear (3) and a system for transferring the bars transverse (4), depositing them on an underlying cooling bed (plate 5), from where they will be, as in the known art, sent to a packing machines (bundle forming machine 51), tying point (6) and storing area (61). This group is also indicated by EBD in FIG. 3.

Obviously the details may vary in many forms of embodiments, though remaining within the field of invention, which consists in operating, on a single large flat by shaping it into preparatory ovals and cutting it in longitudinal bands as rod sections which, always rolled in a parallel group, will reach the desired final section before discarding and eventual cropping in length ofthe bar, or be sent directly in continuous fashion to winding.

Advantageously, at the end of the last rolling phase, it is possible to continue into a thermic treatment continuous tunnel (7).

Figure 4:
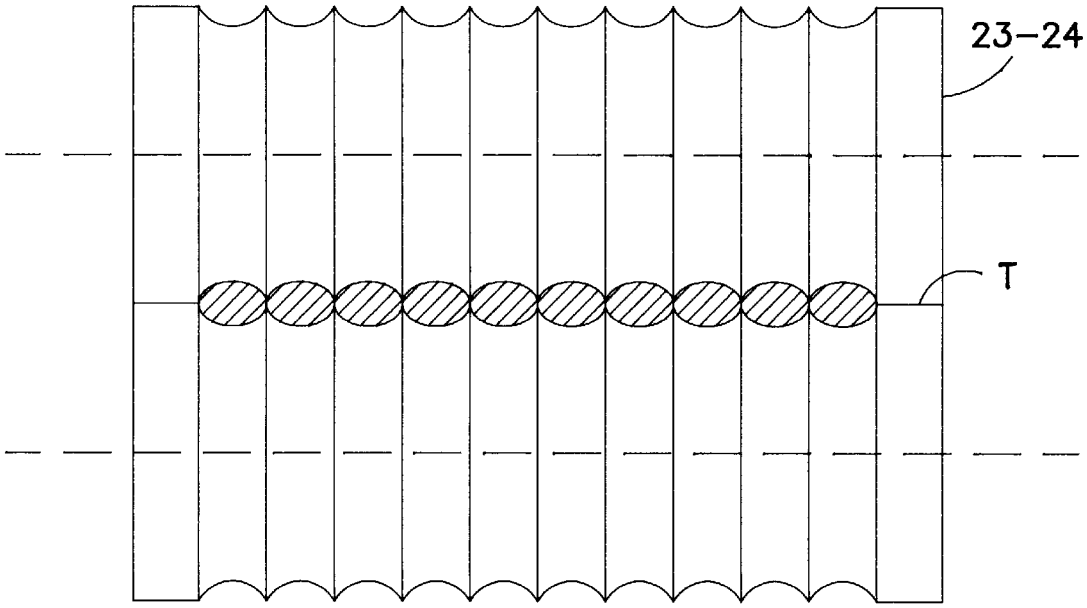
FIG. 4 represents a schematic front view of a couple of rolls used for rolling, comprising a plurality of opposite grooves for the formation of preparatory ovals, which when subsequently separated will become rod sections, iron rods, or small iron rods.
Figure 5:
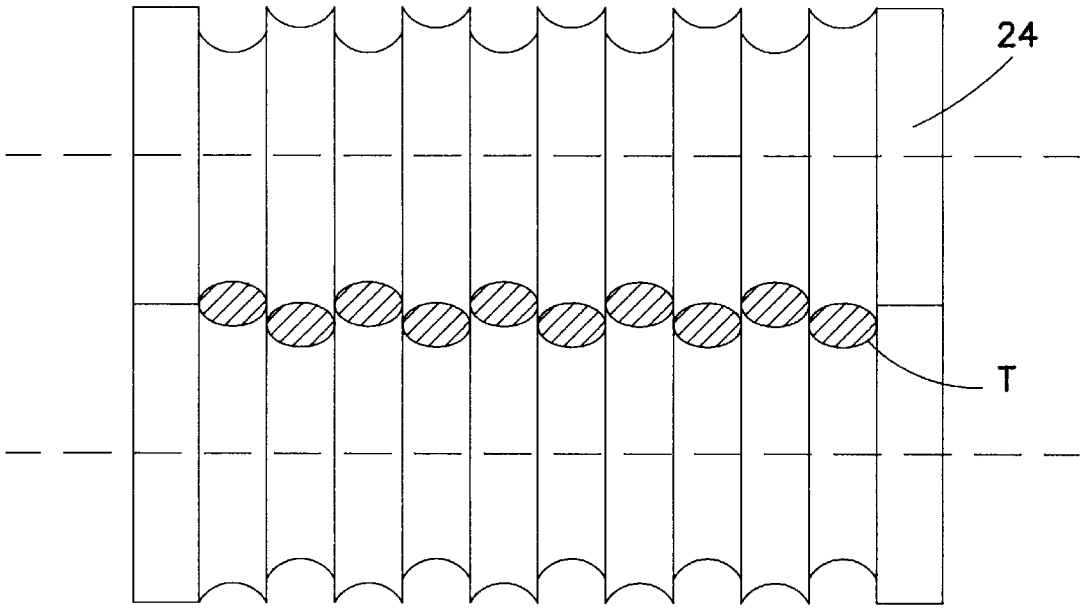
FIG. 5 represents an alternative way of separating the ovals from each other for the formation of the rod sections, iron rods or small iron rods.

The longitudinal cutting or separation to obtain the separate rod sections can also be obtained by using shaping-separating rolls (FIG. 4) by using edges for severing the respective grooves. The edges are very sharp such that only one engraving or movement or bending to sever the single sections from one another will be necessary. Co-penetrating disks can also be used (FIG. 5).

The advancement speed parameters will be considerably lower with respect to the rolling speeds of a single bar. For example, the casting advances with a large and thin flat bloom (50×800 mm) at a speed of 0.1 m/sec.

For example, at the final rolling stand there may be obtained, for iron rods with an 8.5 mm diameter, 54 iron rods with an advancement speed of 1.25 m/sec. and a productivity of about 110 Tons/hour. This means that the series of iron rods (or square ones, etc.) thus produced may be cut to obtain bars having commercial measurement (6–12 m) directly from the flying shear (3) coming out from the last stand.

As mentioned, the layer of bars having the finished measurement could be unloaded directly on the cooling plate (4–5). It is possible to provide a forced cooling before the cutting (3), or afterwards.

When coming out from the cooling bed (plate 5), bundles or packs of straight bars will be formed, which after fastening at (6), will be sent to storage benches (61). For the wire-rod production, as previously mentioned, the layer of bars coming out from the last finishing stand, after discarding (3), will be sent directly to the winding machines (8, 81–82), which will simultaneously wind all the iron rods in a continuous wire. discarding (3), will be sent directly to the winding machines (8, 81–82), which will simultaneously wind all the iron rods in a continuous wire.

This means that in case of iron rods of an 8.5 mm diameter as mentioned, there will be 54 winding bobbins (8) which, instead of staying on two winding machines (81–82), would all stay on a single winding machine with a single spindle, with one close to the other and separated by suitable annular separators. The bobbins will then be transferred with a known technique by bobbin conveyers.

If the weight of the casting were, for example, 50 tons, 54 bobbins each weighing 925 Kg. will be formed, each being on the same winding machine. Otherwise one half of the layer could be sent to one winding group and the other half to the other, each group having 27 bobbins (81–82).

Figure 6:
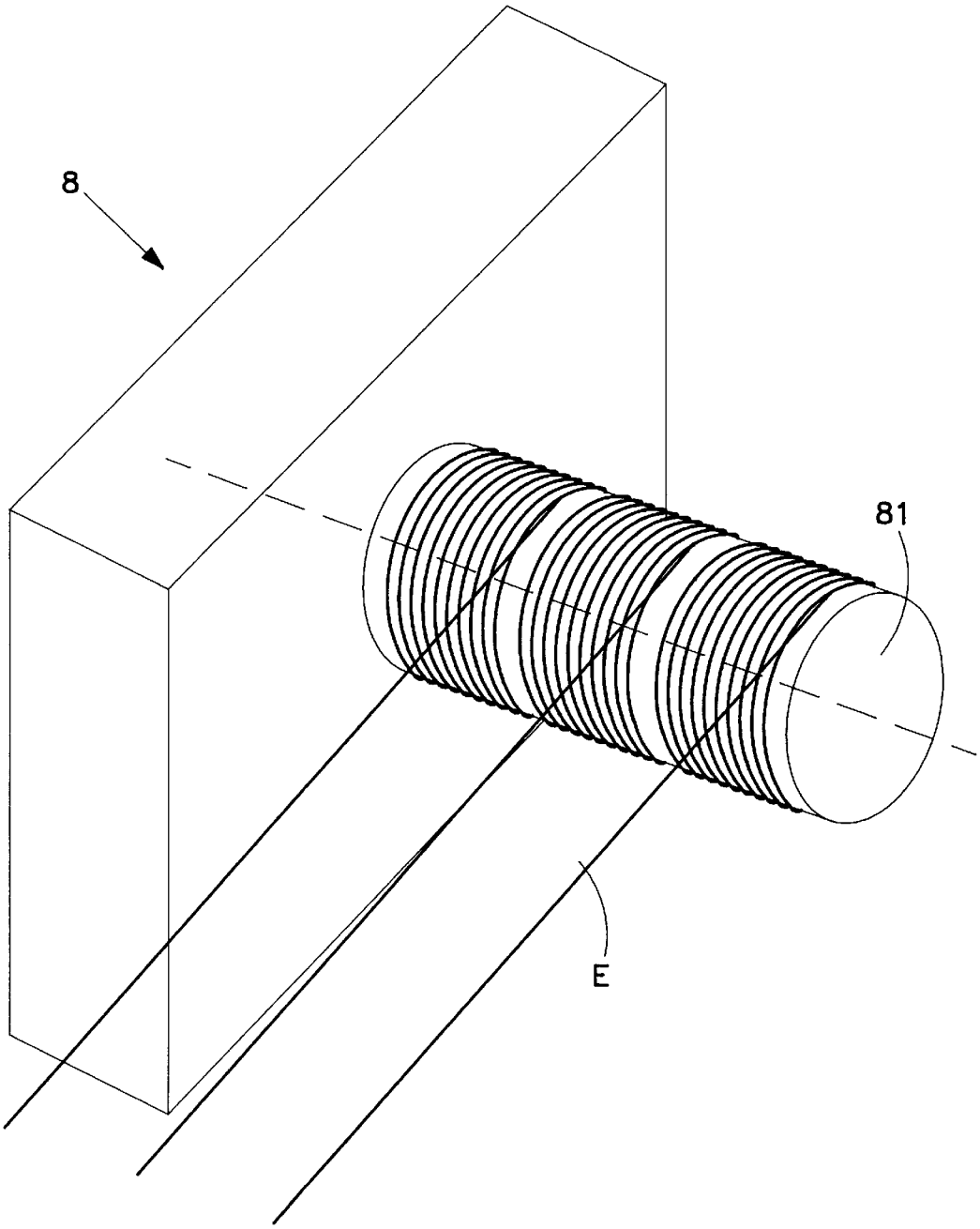
FIG. 6 schematically represents a single-spindle winding group with a plurality of bobbins in winding.

With reference to FIG. 6, it can be clearly seen that the horizontal spindle can wind a multiple number of wires in order to form a number of spools close to each other and equal to the number of wires (E).

The possible rotation ofthe rod sections (D) before the final shape rolling (E) will be properly carried out simultaneously by suitable rotary means and known techniques.

The shaping rolls of the flat (23) can be in a multiple number to obtain a progressive deformation of the large flat in the deformation area "C".

Advantageously, at the end of the continuous casting (1) and at the beginning of the rolling by the flat rolls (22) and/or during the rolling by the flat rolls (22), is installed at least one winding/unwinding system for winding and unwinding the large flat during rolling for reducing its thickness in small spaces, or also for parking (not shown, because it belongs to the known art).

I claim:

1. A hot-rolling plant for the continuous production of bars, iron rods or wire in which a rolled section coming from continuous casting is longitudinally continuously rolled and comprising:

means for continuous casting of a flat bloom having a thickness of less than 80 mm;

an induction tunnel equalizing furnace for heating the flat bloom from said means for continuous casting to maintain the flat bloom at a rolling temperature;

a first rolling stand having vertical rolls for bringing the flat bloom to a constant and exact width;

a rolling stand for transforming the flat bloom from said first rolling stand into a plurality of split strips or bars, said rolling stand comprising:

a first rolling means for rolling a flat shape of the flat bloom, said first rolling means comprising flat pressing rolls for rolling the flat bloom until it is a large flat having a thickness approximate to a largest section of a final rod section to be obtained and a width equal to at least a multiple of the largest section of the final rod section more than two in number, and a second rolling means having opposite annular grooved rollers for forming a flat longitudinally grooved advancing material from the flat and shaping, in contra-position, opposite buckled surfaces and recesses so as to form the section of the flat into a shape of ovals or lozenges that are attached to each other;

longitudinal shearing means for separating the flat longitudinally grooved advancing material into a plurality of strips or bars such that the ovals or lozenges are longitudinally separated in correspondence with respective minimum thicknesses of the flat and so as to create a bed of continuously advancing rod sections which each comprise the bar, iron rod or wire to be obtained;

rotating means for simultaneously rotating the plurality of strips or bars from said longitudinal shearing means 90 degrees;

finishing rolling means having opposite annular grooved rollers for continuously producing finished bars; and a flying shear for shearing the finished bars, a bar unloading means for discharging the finished bars on to a cooling bed and a means for packing and fastening the finished bars positioned after said finishing rolling means.

2. The hot-rolling plant of claim 1, and further comprising a continuous descaling machine for descaling the flat bloom positioned before said first rolling means.

3. The hot-rolling plant of claim 1, wherein said longitudinal shearing means comprises a series of at least coinciding rotating disks.

4. A hot-rolling plant for the continuous production of bars, iron rods or wire in which a rolled section coming from continuous casting is longitudinally continuously rolled and comprising:

means for continuous casting of a flat bloom having a thickness of less than 80 mm;

an induction tunnel equalizing furnace for heating the flat bloom from said means for continuous casting to maintain the flat bloom at a rolling temperature;

a first rolling stand having vertical rolls for bringing the flat bloom to a constant and exact width;

a rolling stand for transforming the flat bloom from said first rolling stand into a plurality of split strips or bars, said rolling stand comprising:

a first rolling means for rolling a flat shape of the flat bloom, said first rolling means comprising flat pressing rolls for rolling the flat bloom until it is a large flat having a thickness approximate to a largest section of a final rod section to be obtained and a width equal to at least a multiple of the largest section of the final rod section more than two in number, and a second rolling means having opposite annular grooved rollers for forming a flat longitudinally grooved advancing material from the flat and shaping, in contra-position, opposite buckled surfaces and recesses so as to form the section of the flat into a shape of ovals or lozenges that are attached to each other;

longitudinal shearing means for separating the flat longitudinally grooved advancing material into a plurality of strips or bars such that the ovals or lozenges are longitudinally separated in correspondence with respective minimum thicknesses of the flat and so as to create a bed of continuously advancing rod sections which each comprise the bar, iron rod or wire to be obtained;

rotating means for simultaneously rotating the plurality of strips or bars from said longitudinal shearing means 90 degrees;

finishing rolling means having opposite annular grooved rollers for continuously producing finished bars; and shearing means positioned after said finishing rolling means for shearing at the same time all finished bars advancing in a plane with opposite rotating cutters.

5. A hot-rolling plant for the continuous production of bars, iron rods or wire in which a rolled section coming from continuous casting is longitudinally continuously rolled and comprising:

means for continuous casting of a flat bloom having a thickness of less than 80 mm;

an induction tunnel equalizing furnace for heating the flat bloom from said means for continuous casting to maintain the flat bloom at a rolling temperature;

a first rolling stand having vertical rolls for bringing the flat bloom to a constant and exact width;

a rolling stand for transforming the flat bloom from said first rolling stand into a plurality of split strips or bars, said rolling stand comprising a first rolling means for rolling a flat shape of the flat bloom, said first rolling means comprising flat pressing rolls for rolling the flat bloom until it is a large flat having a thickness approximate to a largest section of a final rod section to be obtained and a width equal to at least a multiple of the largest section of the final rod section more than two in number, and a second rolling means having opposite annular grooved rollers for forming a flat longitudinally grooved advancing material from the flat and shaping, in contra-position, opposite buckled surfaces and recesses so as to form the section of the flat into a shape of ovals or lozenges that are attached to each other;

longitudinal shearing means for separating the flat longitudinally grooved advancing material into a plurality of strips or bars such that the ovals or lozenges are longitudinally separated in correspondence with respective minimum thicknesses of the flat and so as to create a bed of continuously advancing rod sections which each comprise the bar, iron rod or wire to be obtained;

rotating means for simultaneously rotating the plurality of strips or bars from said longitudinal shearing means 90 degrees;

finishing rolling means having opposite annular grooved rollers for continuously producing finished bars;

a cutting shear positioned after said finishing rolling means; and at least one movable guide groove for receiving cut finished bars from said cutting shear and causing the cut finished bars to fall on to an underlying cooling bed.

6. A hot-rolling plant for the continuous production of bars, iron rods or wire in which a rolled section coming from continuous casting is longitudinally continuously rolled and comprising:

means for continuous casting of a flat bloom having a thickness of less than 80 mm;

an induction tunnel equalizing furnace for heating the flat bloom from said means for continuous casting to maintain the flat bloom at a rolling temperature;

a first rolling stand having vertical rolls for bringing the flat bloom to a constant and exact width;

a rolling stand for transforming the flat bloom from said first rolling stand into a plurality of split strips or bars, said rolling stand comprising:

a first rolling means for rolling a flat shape of the flat bloom, said first rolling means comprising flat pressing rolls for rolling the flat bloom until it is a large flat having a thickness approximate to a largest section of a final rod section to be obtained and a width equal to at least a multiple of the largest section of the final rod section more than two in number, said flat pressing rolls being multiple in number in order to obtain a progressive pressing down of the flat bloom, and a second rolling means having opposite annular grooved rollers for forming a flat longitudinally grooved advancing material from the flat and shaping, in contra-position, opposite buckled surfaces and recesses so as to form the section of the flat into a shape of ovals or lozenges that are attached to each other;

longitudinal shearing means for separating the flat longitudinally grooved advancing material into a plurality of strips or bars such that the ovals or lozenges are longitudinally separated in correspondence with respective minimum thicknesses of the flat and so as to create a bed of continuously advancing rod sections which each comprise the bar, iron rod or wire to be obtained;

rotating means for simultaneously rotating the plurality of strips or bars from said longitudinal shearing means 90 degrees; and finishing rolling means having opposite annular grooved rollers for continuously producing finished bars.

* * * * *